US005137391A

United States Patent [19]

Ballesteros

[11] Patent Number: 5,137,391

[45] Date of Patent: Aug. 11, 1992

[54] PROCESS TO MANUFACTURE "IN SITU" SAFETY BARRIERS FOR ROADS

[76] Inventor: Angel G. Ballesteros, La Espuela 3, 29016 Malaga, Spain

[21] Appl. No.: 547,749

[22] Filed: Jul. 2, 1990

Related U.S. Application Data

[63] Continuation-in-part of Ser. No. 210,024, Jun. 2, 1988, abandoned.

[51] Int. Cl.[5] ..... E01F 13/00; E01F 15/00

[52] U.S. Cl. ..... 404/6

[58] Field of Search ..... 404/6; 403/230, 231, 403/232

[56] References Cited

U.S. PATENT DOCUMENTS

| | | | |
|---|---|---|---|
| 1,170,545 | 2/1916 | Keenan | 404/6 X |
| 3,678,815 | 7/1972 | Younker | 404/6 X |
| 4,105,353 | 8/1978 | Bork et al. | 404/6 X |
| 4,249,832 | 2/1981 | Schmanski | 404/6 |
| 4,307,973 | 12/1981 | Glaesener | 404/6 |
| 4,348,133 | 9/1982 | Trent et al. | 404/6 |
| 4,406,563 | 9/1983 | Urlberger | 404/6 X |
| 4,502,812 | 3/1985 | Zucker | 404/6 |
| 4,576,507 | 3/1986 | Terio | 404/6 |
| 4,681,302 | 7/1987 | Thompson | 404/6 X |
| 4,684,287 | 8/1987 | Wojciechowski | 404/6 |
| 4,785,577 | 11/1988 | Lederbauer | 256/13.1 |
| 4,844,652 | 7/1989 | Schroughan | 404/6 |
| 4,964,750 | 10/1990 | House et al. | 404/6 |

FOREIGN PATENT DOCUMENTS

| | | | |
|---|---|---|---|
| 2557896 | 7/1985 | France | 404/6 |

*Primary Examiner*—Ramon S. Britts
*Assistant Examiner*—Nancy P. Connolly
*Attorney, Agent, or Firm*—Ladas & Parry

[57] ABSTRACT

A process of manufacturing "in situ" safety barriers for roads and highways, forming barriers between opposite traffic ways. The process is based on forming wholly enclosed moulds. The containers may have means for attachment of other adjacent moulds. These moulds when empty are light and transportable. They are transported and located in a position of use. Once in position, the moulds are filled with a suitable material to give it additional weight. An example of such material is concrete from a concrete mixer truck. Other materials can also be used. The mould can be made of any suitable material (polyester resin compounds, polyester, steel sheet, rigid plastics, . . . ). Such barriers have a large range in uses (versatility), including, but not limited to: use for fixed protection, use for mobile protection, use as ecological barriers, use as an acoustic signal in mobile works. One embodiment has an upper filler mouth and holes for air exit, as well as lower projections that form legs, so that the barrier remains slightly separated from the ground and allows the flow of the water under the mould.

29 Claims, 8 Drawing Sheets

DETAIL OF THE IRRIGATION MODULES AND PLANTS IN THE DRAIN
E=1:50

PROCESS TO MANUFACTURE "IN SITU" SAFETY BARRIERS FOR ROADS

This application is a continuation-in-part of application Ser. No. 07/210,024, which was filed on Jun. 2, 1988, now abandoned.

BACKGROUND OF THE INVENTION

This invention refers to a process to manufacture "in situ" safety barriers for roads and highways, being applicable also to the manufacturing of special curbs.

In the making of roads and as a means of separation and safety between opposite traffic ways, it is necessary to install a protecting member intended to fulfill two main objectives:

a) To prevent a vehicle that has suffered an accident from invading traffic lanes for cars travelling the opposite way; and b) To allow the passage of water in case of rain or flood, there being a passage under said protecting member so that there is no stagnation of water flooding a given way, flooding which may otherwise result in interrupting traffic or at least causing an accident.

One way of manufacturing said safety barriers is shown in FIG. PA-1 which consists of some sheet strips (1) coupling rigidly to small metal pillars (2) nailed to the ground. This safety barrier performs the required functions of limiting and absorbing the kinetic energy of the mass of the vehicle and allowing the passage of water. This type of structure has drawbacks in that it is not particularly durable and can be permanently deformed by relatively low impacts. This results in high maintenance costs.

Another way of manufacturing such safety barriers is shown in FIG. PA-2, which is based on concrete blocks (3) in mass prefabrication, in a shape more or less arched and joined together semi-rigidly and with a great enough mass to withstand the shock and impact of a vehicle. These blocks have on their underside projections or legs (4) to allow the passage of water.

The blocks have usual minimum dimensions of 70 cm wide, 80 cm high and 100 cm long. Taking into account the concrete density, the mass of each member or block will be approximately 1,175 Kg. With regard to the previous system, it has the advantage that its maintenance is practically nil.

In both cases, the safety barrier is installed when the road is quite finished, including in said finishing the rolling layer, road borders, etc.

As the process referred in the present invention is intended to replace the barriers made from prefabricated concrete members, the features of this manufacturing method are going to be analyzed, that is, the features of the barriers made of prefabricated concrete blocks, which have the following characteristics.

Material: The concrete must be white and made by using white cement or cement from some quarries of special materials that give a light-colored texture. The typical strength is between 150 and 175 Kg/cm$^2$.

Manufacturing: it is performed in factories duly provided with enough moulds. The process is as follows: filling of the concrete moulds, vibrating, setting and subsequent unmoulding. Because of the weight of each block, loading and unloading for storage is done with a crane.

Storage: The area of each block is 700 cm$^2$ (100×70 cm), being the height with legs approximately 77 to 85 cm.

From the foregoing, it is easy to note the great difficulty to store the blocks, because they cannot be stacked and must remain nearby. Let us consider the required area for storage. Let us take a road of 10 Km that requires the manufacturing of 10,000 blocks. The minimum storage area must be 1,000 m$^2$, that is, an area bigger than a football field.

Handling: It always requires a crane and the assistance of one or more workers.

Transport: By using a truck of 2.50 m×10 m, the amount of 1 m long blocks that the truck can carry will be 35 units maximum, this limitation caused by their area and mass.

Handling at work: The minimum number of operations at work is two, stacking on the edge of a road and mounting in the final location in the middle of the road.

Terms: At present, public works depend on the economic factor and also on the termination term, so that the time required to finish a road through concrete barriers must be necessarily long, because there are four main disadvantages:

(1) Slow manufacturing.

(2) Big stacking areas.

(3) High costs, because the expenses for the concrete are incurred since the early step of manufacturing, resulting in high storage costs or delays in supplies because of slow manufacturing.

(4) Great difficulty in handling, with cranes and personnel being required, resulting in a slow handling.

SUMMARY OF THE INVENTION

Taking into account the aforesaid features and disadvantages of the system of manufacturing protection or safety barriers in roads, the process of the present invention has been designed to provide a barrier manufacturing system much more rational and more advantageous than those known and above-mentioned.

The manufacture of security barriers has been made up to now using different types of solutions such as that which is found in U.S. Pat. Nos. 4,348,133 and 4,496,264, using concrete, sand or other type of heavy material like ballast. Both have the same philosophy, varying only in the material that makes up the barrier and its external finishing, and the method of securing it to the land, which in one case is more expensive than in the other. In both cases, the physical principle is the same: a U mold which has to be secured to the land so that it does not float when filled with concrete. The limitations of both of these U.S. patents are identical. They are limited to construction of rigid barriers anchored to the ground and do not allow for the disassembly of part of the barrier. Further, such barriers cannot be used in mobile or maintenance works as they are not barriers which can be easily handled.

The present invention is based in achieving a mould which, after being placed in the definitive location of the road, will be filled with a mass of suitable material. Such a barrier has versatility. The range of uses can be, but is not limited to: use for fixed protection, use for mobile protection, use as an ecological barrier, use as an acoustic signal in mobile works, etc.

For example, as a road or highway safety barrier, a product with a density similar to concrete is used. In another example where the invention can be used to protect the highway worker, such a barrier can be filled with sand, water or expanded polyurethane.

As for manufacturing, this will be based on performing the mould through a base mould that constitutes the containing member, which later will be filled with a suitable material.

The said mould can be made of polyester, sheet metal, rigid plastics, etc., or any other light, resistant material. In any case, the weight of the mould per meter should not be higher than 30 Kg. The shape of the mould will be suitable for a particular application and its requirements. The preferred embodiment is mainly based upon 2 m long units, with a weight of 22 Kg each, constructed of a polyester resin fiber compound structurally calculated to support the hydrostatic pressure of the material used for filling: concrete, water, sand, etc.

The manufacturing technology which the requesting party uses is that of S.M.C. compression forming (PRC). The following are basic elements in this method: a press with a high compression capacity, a steel mould with the circulation of thermal oil for its heating, and a boiler. This equipment provides us with a production rhythm of 1 lineal meter every 3 minutes.

The mechanical and chemical resistance qualities, and the life span of the PRC, polyester resins compounds strengthened with fiber glass, are very well known in the technology world. Their use in automotive, naval, transportation, aero-naval and space industries are evidence regarding the use of this material, due to its lightweight and versatility.

It is possible for us to make a resistant material which weighs very little because PRC is the material that makes up the requested patent. Another additional advantage is that we can finish it (including mass) in the desired color, whether white or other light colors which, we understand, can be used to improve the visibility of the barrier during the day and night.

As for the dimensions of said mould, they will be the suitable ones for each requirement. In any case, as compared with the blocks used in above-mentioned conventional systems, it is seen that for the same dimensions, the storage of the moulds, forming part of the invention, will require an area lower than required to store the conventionally known blocks because the present invention can be stacked.

Likewise, handling will be easier, because of lightness of moulds, which can be carried to a worksite after finishing the road, to place them in a suitable place, requiring no more than a worker to fill them with a material, for example, concrete from a concrete mixer through a gravity device.

The transport of the moulds is made easier, because owing to their being less weight, more units of the moulds can be carried than in the case of concrete blocks.

The manufacturing of the barriers of the present invention is easier in comparison to the methods known until now, as the product needs only to be placed and filled on site.

The advantages that affords the method of the invention can be summarized as follows:

Manufacturing speed.

Visibility of a barrier as it can be manufactured in any color.

Handling ease.

Marking speed.

Replacement ease.

Reduction of installation costs without any type of soldering processes, special attachments, etc. on site.

Minimal and economical maintenance.

Possibility to incorporate soft strip to limit the mould.

Possibility to use the mould or moulds as a marking means, combining units with different colors, for instance, red and white.

Economy and terms.

Higher finishing quality.

Possibility to use any semi-rigid fixing system between moulds.

Possibility to make the moulds in any geometric shape, adapting to the requirements of each application.

Such a barrier has a large range of uses (versatility), including, but not limited to:

Use for fixed protection.

Use for mobile protection.

Use as ecological barriers.

Use as an acoustic signal in mobile works.

For example, in terms of safety, a barrier of the present invention offers:

Protection to the driver, barriers filled with concrete.

Protection to the highway worker, barriers filled with sand, water or expanded polyurethane.

Protection to pedestrians and environment, ecological barriers.

From the comparison as follows, can be seen the aforesaid advantages and others that illustrates the new system or method to make safety barriers with regard to the conventional or present system in which the barriers are made of prefabricated concrete blocks.

COMPARISON OF SYSTEMS

| Concept | Conventional System prefabricated concrete | System of the present invention |
|---|---|---|
| Weight in shop | 1,100 Kg/m | 30 Kg/m |
| Weight, finished on the road | 1,100 Kg/m | 1,130 Kg/m |
| Finishing, texture | coarse | smooth |
| Stability to agents atmospheric | good | good |
| Base material | concrete only | any, with density 2,1 |
| Possibility of writing, marking, stripping . . . | No | Yes |
| Handling at work | Bad | Excellent |
| Supply | Slow | Quick |
| Execution at work | Slow | Quick |
| Transport | Difficult-expensive | Easy-cheap |
| Manufacturing | Slow | Quick |
| Stacking-storage | Bad | Excellent |
| New designs | Difficult | Easy |
| Maintenance | Good | Excellent |
| Spare parts | Good | Excellent |
| Can save markings? | No | Yes |

From the drawings, the scope of the invention can be understood, as well as the barriers made according to the recommended method, all this being illustrated for an orientative and non-limiting end.

DESCRIPTION OF THE PREFERRED EMBODIMENT

Figure 1:
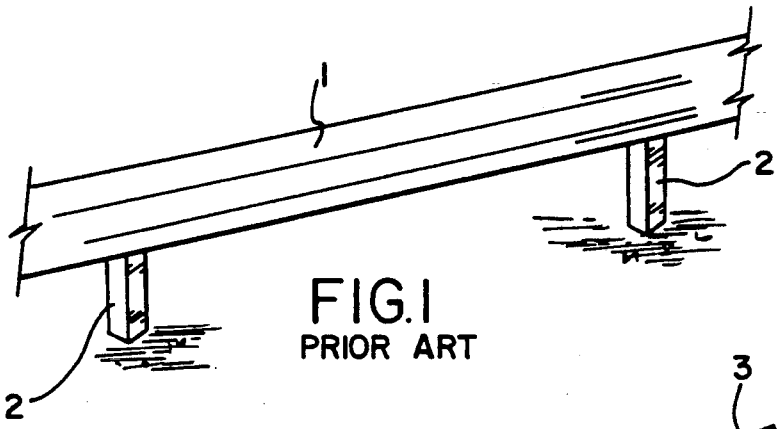
FIG.1 PRIOR ART
FIG. 1 (FIG. Prior Art—1) is a schematic view of a conventional protective safety barrier.

FIG. 1 (Prior Art 1) illustrates a schematic view of a protection or safety barrier relative to the state of the art defined at the beginning of this specification. The barrier is made from sheet strips (1) attached to small pillars (2) nailed to the ground.

Figure 2:
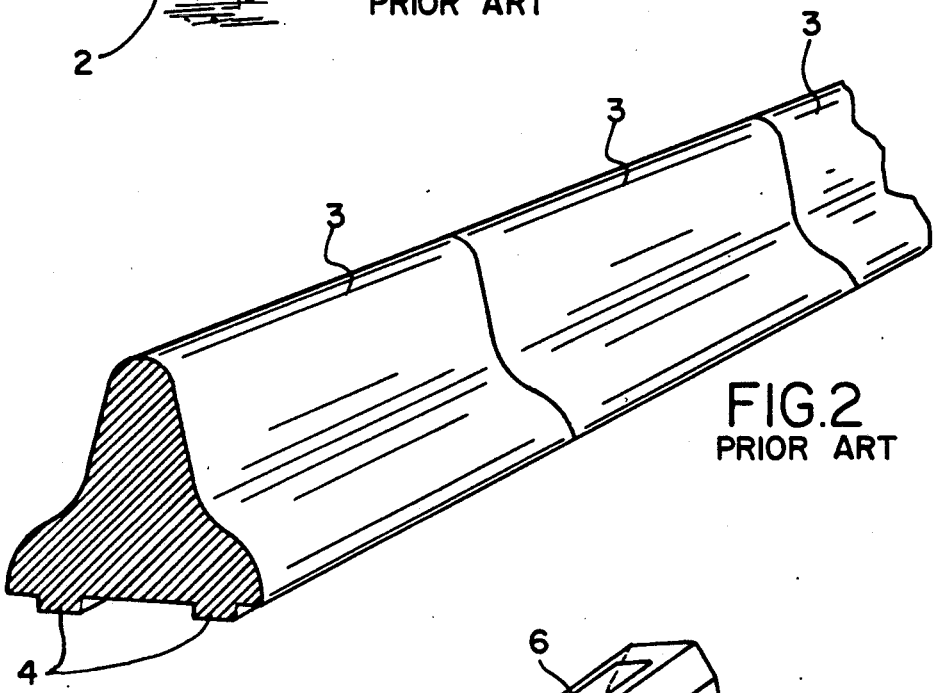
FIG.2 PRIOR ART
FIG. 2 (FIG. Prior Art—2) is a schematic view of another conventional safety barrier.

FIG. 2 (Prior Art 2) shows a schematic view of another safety barrier relative to the state of the art. This barrier is made of concrete blocks (3), mass fabricated, joined together semi-rigidly, and provided with under projections or legs (4).

Figure 3:
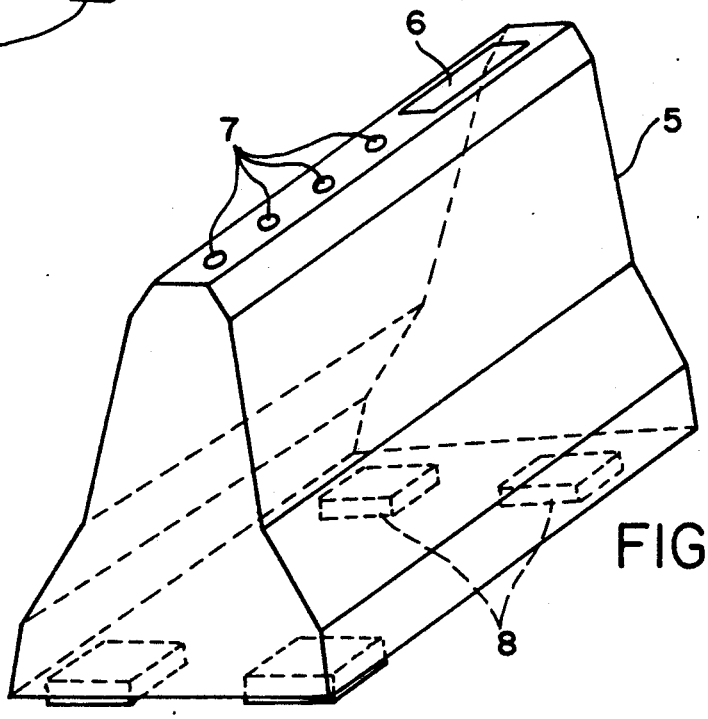
FIG. 3 shows a perspective view of a mould made of sheet, plastics, or any suitable material in one of the manufacturing shapes which is intended to be filled with a material to form the barriers made according to the present invention.

FIG. 3 shows a perspective view of a mould made of sheet metal, plastics, or any suitable material in one of the manufacturing shapes which is intended to be filled with a material to form the barriers made according to the present invention.

Figure 4:
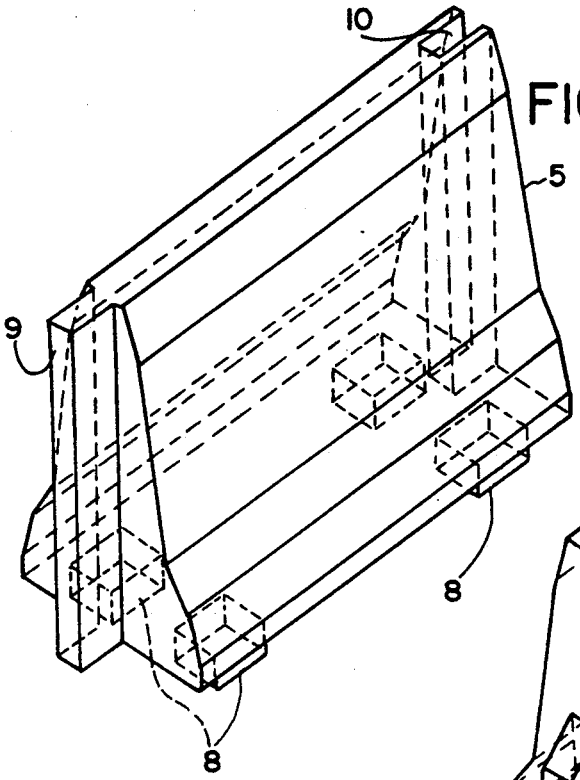
FIG. 4 shows another perspective view of a new model block already manufactured, corresponding also to the object of the invention showing side coupling means.

FIG. 4 shows another perspective view of the invention with side coupling means.

Figure 5:
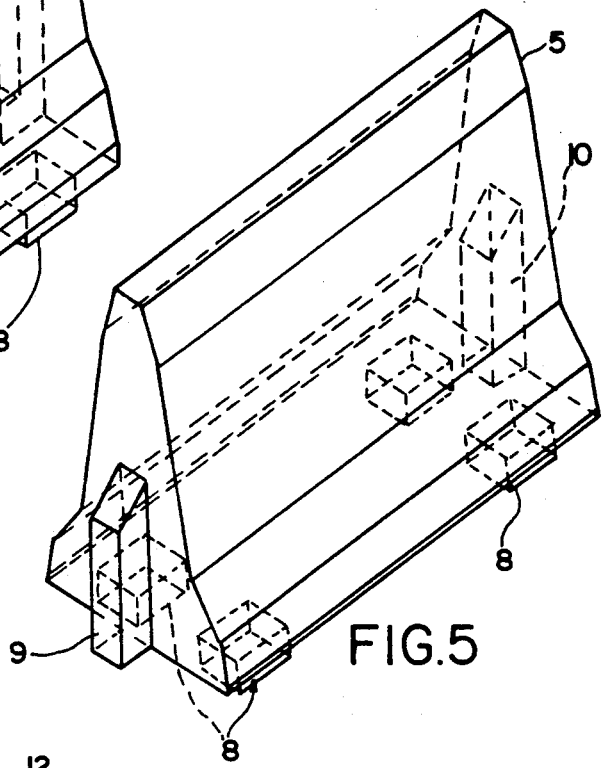
FIG. 5 shows another embodiment with a different side coupling system.

FIG. 5 shows another embodiment with a different side coupling system.

Figure 6:
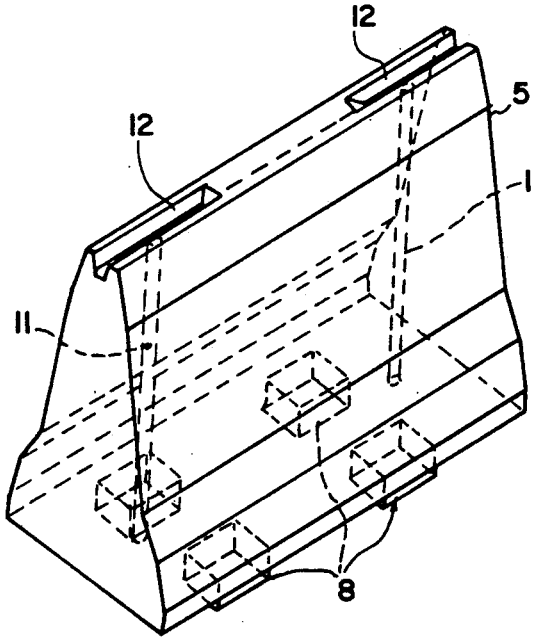
FIG. 6 shows another embodiment with a different coupling system, consisting in this case of two metal bars embedded inside the vertical-shaped block, which project from its ends so that fixing is performed through these, by nuts and pletine, or by springs.

FIG. 6 shows another embodiment with a different coupling system, consisting in this case of two metal bars embedded inside the vertical-shaped block, which project from its ends so that fixing is performed through these, by nuts and pletine, or by springs.

Figure 7A:
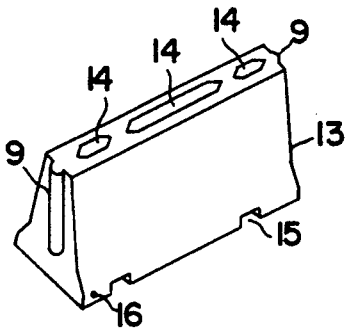
FIG. 7*a* is a view of a male mould.

FIG. 7*a* shows a male mould (13) provided with lugs on its ends (9), with water passage (15) and if desired, perforations (16) in which to place a water exit valve when the mould is filled with water in mobile works. Also shown is a sample of a visualization device (37) which can be added to a mould.

Figure 7B:
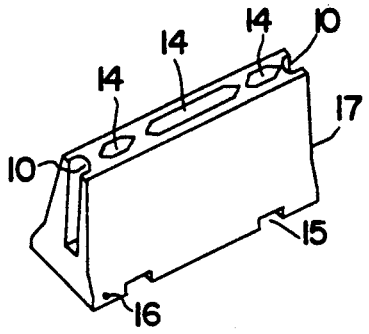
FIG. 7*b* is a view of a female mould.

FIG. 7*b* shows a female mould (17) provided with couplings or recesses on its ends (10), with water passage (15) and if desired, perforations (16) in which to place a water exit valve when filled with water in mobile works.

Figure 7C:
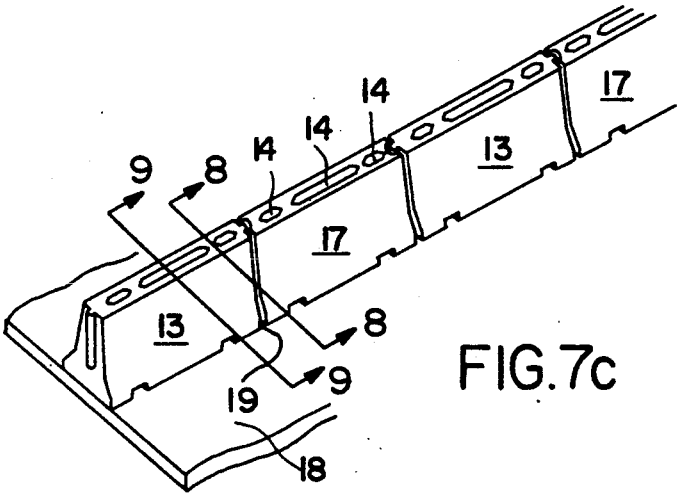
FIG. 7*c* snows a plurality of moulds in an alternating manner of male-female moulds.

FIG. 7*c* shows a plurality of moulds, the placing of the moulds in an alternate manner, male (13) - female (17), and empty, lining them up on the completely finished highway. A surface for rolling is shown at (18), a joint or separation between moulds (19), loading docks for the ballast (14) which may be covered or not, according to the need. If using concrete as ballast, it must be filled connecting the outlet of the concrete truck to the central dock (14). If at any moment it becomes necessary to disassemble the barrier, this can be done by simply extracting a male mould and then continue removing the adjacent moulds. When filled with concrete, for example, this can be done using a crane.

Figure 8:
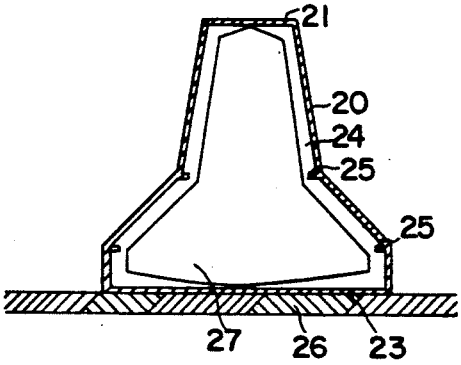
FIG. 8 is a cross-sectional view of a mould of PRC through section A—A of FIG. 7*c*.
Figure 9:
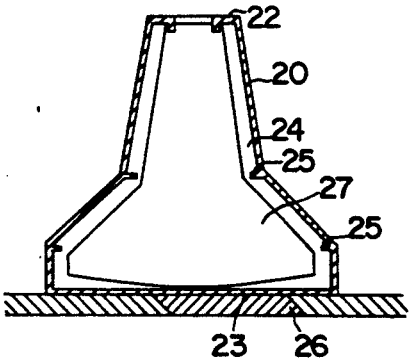
FIG. 9 is a cross-sectional view of a mould of PRC with a border through section B—B of FIG. 7*c*.

In FIGS. 8 and 9, the formation of the basic mould is shown. FIGS. 8 and 9 correspond to sections A—A and B—B of FIG. 7. For example, in FIGS. 8 and 9, lateral walls made of PRC, 2 mm thickness is shown at (20); upper walls made of PRC, 2 mm thickness is shown at (21); upper walls made of PRC, 2 mm thickness, and border of 5 mm thickness is shown at (23); transversal PRC nerves or ribs which make up the part of the structure necessary to support a stress due to hydrostatic pressure, when filling with concrete, water, etc. is shown at (24); longitudinal PRC nerves or frames which make up the reticular structure along with the transversal nerves is shown at (25); a finished highway or location is shown at (26); a filling material is shown at (27). It is not necessary to secure the mould to the land as the mould of the present invention, having a base, will not float when filled with a material.

Figure 10:
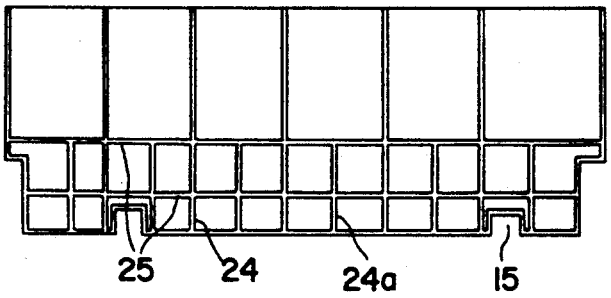
FIG. 10 is an elevational view of a section following the longitudinal axis of a mould.
Figure 11:
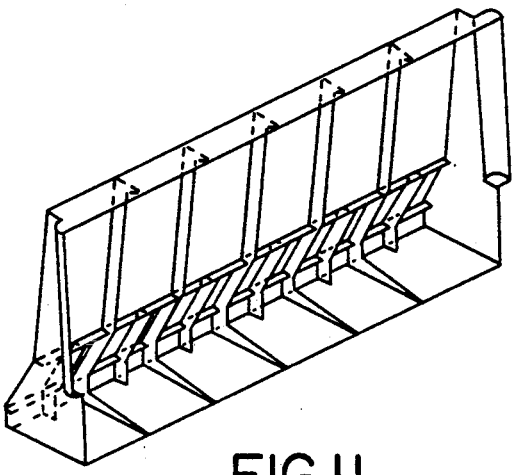
FIG. 11 is a perspective view of a section of a mould.

In FIGS. 10 and 11, FIG. 10 is an elevation of a section, FIG. 11 is a perspective view of a section following the longitudinal axis of the mould, which shows the distribution of the interior armature which avoids the deformation of the mould to be filled. Transversal reinforcements or ribs is shown at (24); single transversal reinforcement in lower part is shown at (24*a*); longitudinal reinforcements or frames is shown at (25); passage of water is shown at (15).

Figure 12:
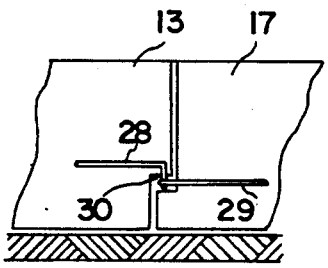
FIG. 12 is a section of an articulated barrier along the longitudinal axis.
Figure 13:
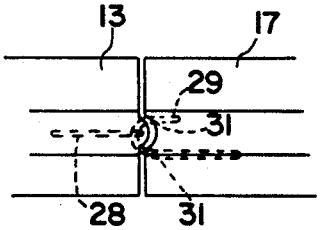
FIG. 13 is a top plan view of the articulated barrier of FIG. 12.

In FIGS. 12 and 13, a semirigid joint is shown. A male mould is shown at (13); a female mould is shown at (17); a rod, 20 mm diameter, in the shape of an L is attached at (28); a rod 20 mm diameter in the shape of a wishbone communicates at (29); perforation of rod (29) is contained at (30); perforation of rod (28) is contained at (31).

Figure 14:
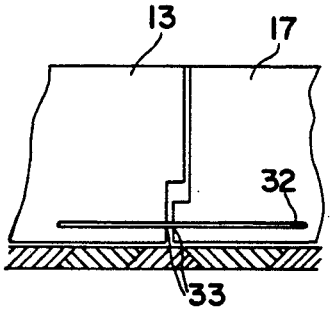
FIG. 14 is a section of a rigid barrier along the longitudinal axis.
Figure 15:
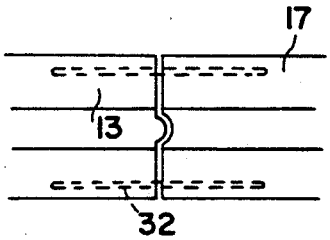
FIG. 15 is a top plan view of the rigid barrier of FIG. 14.

FIGS. 14 and 15 are side and sectional views of male and female rigid barriers. A male mould is shown at (13); a female mould is shown at (17); steel rods, 20 mm of diameter are shown at (32); housing perforations for the steel rods (32) is shown at (33).

Figure 16:
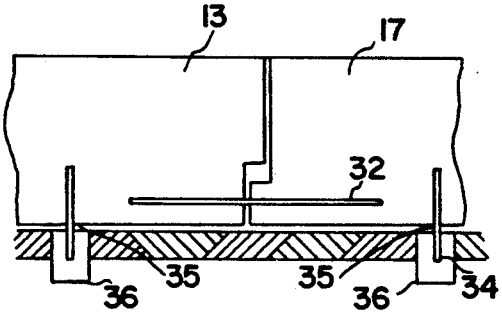
FIG. 16 is a section of a rigid and anchored barrier along the longitudinal axis.
Figure 17:
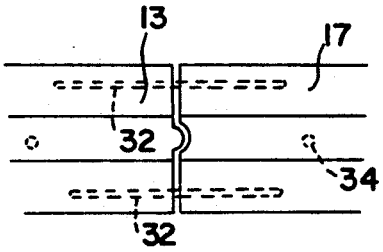
FIG. 17 is a top plan view of the rigid and anchored barrier of FIG. 16.

FIGS. 16 and 17 shows rigid and anchored barriers, at (13) a male mould is shown, a female mould is shown at (17); steel rods of 20 mm diameter are shown at (32); rods attached to the ground are shown at (34); housing openings for steel rod (34) is shown at (35); special mortar is shown at (36).

Figure 18:
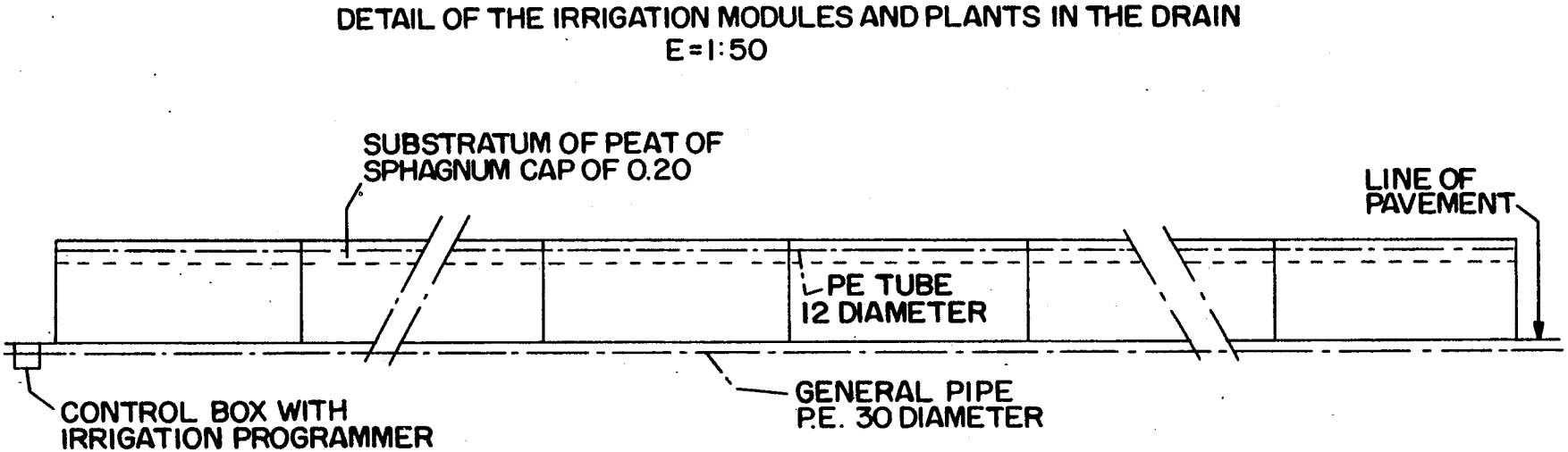
FIG. 18 is a sample of an ecological barrier, for example, illustrating irrigation moulds.

FIG. 18 is an ecological barrier, for example, an irrigation mould, using the following method: a mould is filled with concrete up to a height of 60 cm, complying with the security regulations for barriers in areas of low speed (the mould has a height of 80 cm). Once the concrete has set, it is filled with soil, or pellets for hydroponic cultivation in the remaining 20 cm. A drop irrigation system is installed and the plants are sown. The sowing is made by means of flower pots designed to be introduced in the existing spaces of the upper part of the mould.

Figure 19A:
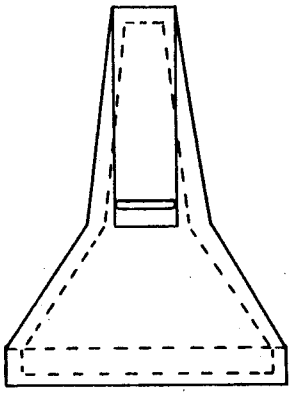
FIG. 19*a* is a side view of the barrier with an electrical component.
Figure 19B:
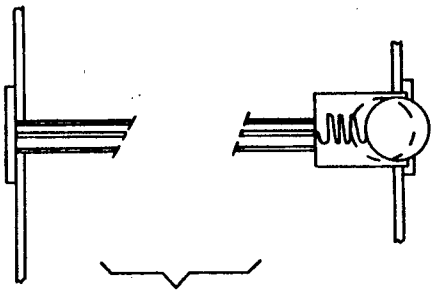
FIG. 19*b* is a view of an electrical component incorporated for use in the barrier.
Figure 19:
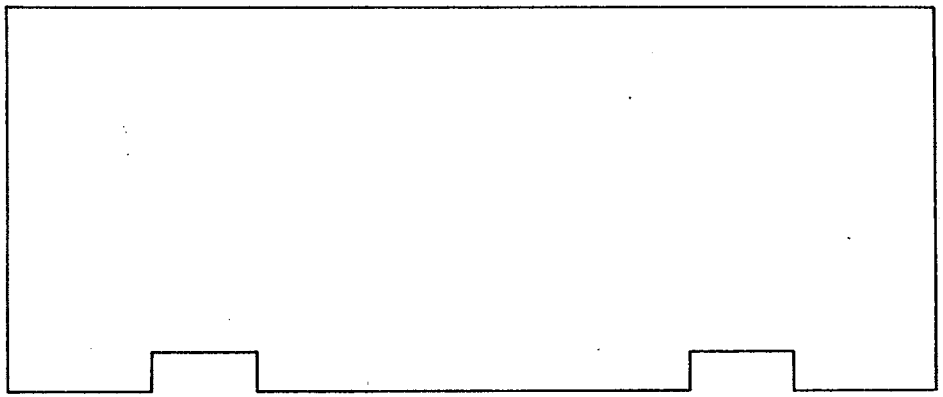
FIG. 19 is a section of a barrier with details of an electrical component.
Figure 19:
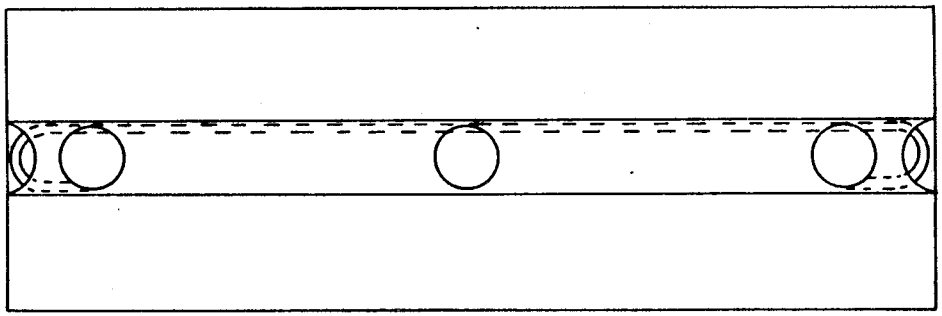

FIGS. 19, 19*a* and 19*b* shows a section of a barrier with details of an electrical component.

Figure 20A:
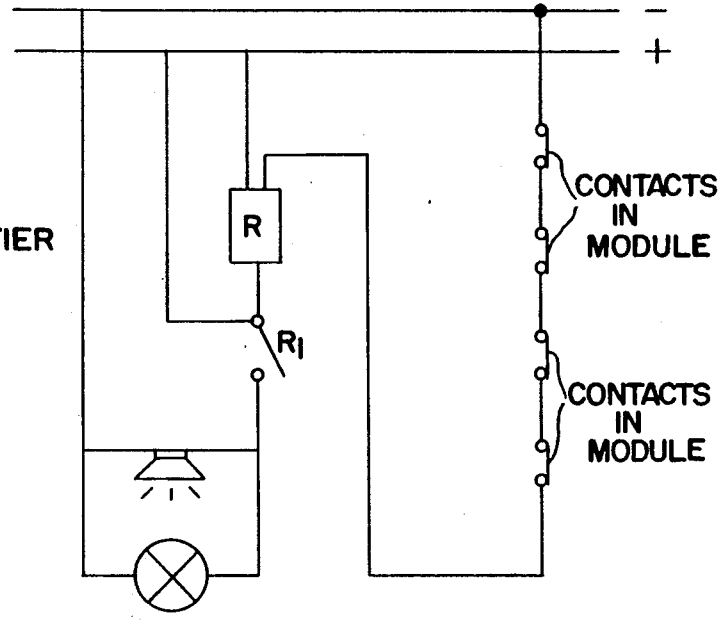
FIG. 20*a* shows a power supply assembly for a traffic warning signal.
Figure 20:
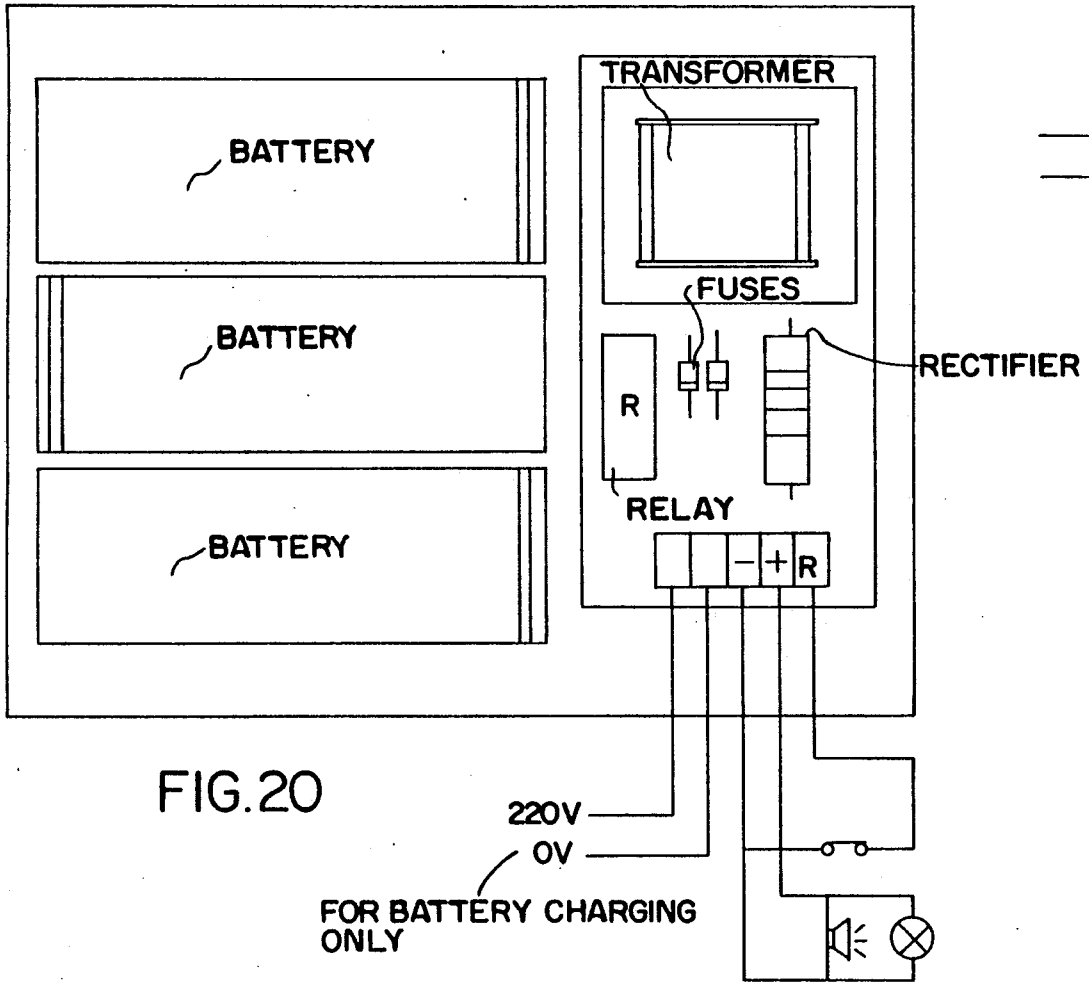
FIG. 20 show a traffic warning signal and power supply assembly.

FIGS. 20 and 20*a* shows a traffic waring signal and power supply assembly with a battery (1), relay (2), transformer (3), fuses (4), and rectifier (5).

Referring to FIGS. 3, 4, 5, and 6, the recommended method is based on a mould (5) that can have any geometric configuration, being provided, on the top, with a filling hole (6) and air exit holes (7) while the bottom has the projections (8). acting as support legs. The mould is made from a light material such as polyester, steel sheet, rigid plastic or other suitable material.

The mould so made can be manufactured in a factory and carried later to the worksite, locating it in the definitive place of the road, and then filling it with a material, for example, material whose density is similar to concrete. In the case where concrete filler is used, the filling can be performed direct from a concrete-mixer through a gravity device coupled to the mixer and, at the opposite end, to the filling mouth (6) of the mould (5), allowing that a sort of funnel can be placed on the filling mouth. After the mould is filled with the filling material, it becomes a block to be used as a safety barrier for roads and highways.

The road barriers can be made quickly, requiring on the other hand, a reduced stacking surface and having the advantage of storing all the required moulds for a road without big costs because the mould is cheap and the concrete will not be used until the last moment.

It must be noted too that through this system a lot of filling can be performed "in situ", since the filling is made at the worksite. This is not the case for the system of prefabricated blocks because in fabricating the blocks, it is necessary to wait until the concrete sets and to unmould before making another filling.

As illustrated in FIGS. 4 and 5, the block made according to the method of the invention, referred to as (5) in those figures, has side coupling means to have the barrier finished on the road, this coupling means formed by a side projection (9) mating in a recess (10) provided in the opposite side, causing the blocks to match. This invention also includes relative lower projections or legs (8).

In FIG. 6 is illustrated another block (5), in which the means to engage an adjacent block is a pair of rods (11) encased in the concrete. The rods (11) are metallic and rigid, and are housed in tubes of suitable diameter, which are integral with the block. The rods (11) project a short distance through the top and the bottom, the block being provided in the top with some grooves (12) to arrange relative strips and nuts that will screw in the projecting and threaded ends of the rods (11), forming the fixing between the blocks or moulds (5).

Besides, it has been foreseen that the projections of the rods can have a transverse hole, to attach the ends of the spring that, in this case, will constitute the fixing. The block (5) has also the relative lower projections or legs (8).

The design of the basic mould, as a container, having walls on all its surfaces, and given its preferred construction in PRC, allows us to anticipate perforations in its construction which are marked (at a lesser thickness) in such a way as to be easy to break when we want to use them on site, allowing the possibility of drain perforations (16). The perforation is illustrated in FIGS. 7*a* and 7*b*. However, perforations can be placed on all embodiments such as perforations for the articulated barriers of FIGS. 12 and 13; perforations for the rigid barriers of FIGS. 14 and 15; and perforations for the rigid and anchored barriers of FIGS. 16 and 17. PRC technology allows for these types of uses, which is impossible to obtain with other materials.

The versatility of the basic mould of the present invention provides many kinds of uses of the barriers, including, but not limited to:

A. Barriers for use in mobile works as protection for highway workers. For example, a mould such as the one shown in FIGS. 7*a* and 7*b* is used, filling it with water or another element which is easy to empty or is light, allowing an easy transportation of these moulds as the work progresses.

B. Articulated barriers which allow the disassembly of any part, for example as shown in the manner in FIGS. 12 and 13. One section is along the longitudinal axis, the other is a ground plan, respectively.

The semirigid joint and the method of attaching one piece to the other provides the whole with a hinge joint which allows the barrier to absorb the energy of the impact in vertical component to the barrier. This barrier solution allows the disassembly of any of its elements.

C. Rigid barriers. These moulds are provided with perforations in the lateral faces through which some rods of 20 mm of diameter are inserted which, when the mould is filled with concrete, remain embedded in it making up a continuous beam, or a continuous barrier as shown in FIGS. 14 and 15, which correspond to a section according to a longitudinal axis of the piece and a ground plan.

D. Rigid and anchored barriers. The manner of operation is the same as the previous one, except that a rod which is anchored to the ground is inserted through the perforation that the mould has on its base. This rod is anchored according to the attachment method chosen and its distance. For example, a rod could be used every 8 meters. Once it is formed, the whole acts as a rigid and anchored barrier as shown in FIGS. 16 and 17.

E. Ecological barriers. The present invention allows the construction of ecological barriers as shown in FIG. 18, using, for example, the following method:

The mould is filled with concrete up to a height of 60 cm, complying with security regulations for barriers in areas of low speed (the mould has a height of 80 cm).

Once the concrete has set, it is filled with soil, or pellets for hydroponic cultivation, in the remaining 20 cm.

Finally, the drop irrigation system is installed and the plants are sown. The sowing is made by means of flower ports designed to be introduced in the existing spaces of the upper part of the mould.

As an additional complement to its ecological functions, the barrier may be made with a mould which has a hole or lower orifice which allows small animals to cross the highway through these holes, avoiding the natural barrier that the installation of any kind of barrier implies. The plants, beside their ornamental and chlorophyllic functions would have natural antiglare functions. (See FIG. 18) The barrier serves a safety function as well as help beautify city or urban routes and help in its oxygenation.

Expanding Mobile barriers. It is important to expand the concept of the need that this kind of barrier presents and which can be solved by the system of the present invention. The needs to be satisfied are those of safety, light weight, easy visibility, and some signal that may let the worker know when a vehicle passes into the protected zone. The present invention when filled with water, sand or expanded polyurethane, and giving the moulds an adequate color (white, for example), satisfies the first three needs. In regards to visibility and warning the workers, this is solved in the following manner:

Visibility. In principle, the main purpose that the barrier must have for mobile works must be its easy visibility during the day and night.

The present invention's system using polyester fiber (PRC) as a raw material in the construction of the mould and the possibilities of pigmentation and coloring of this material are well known in the industry. White would be the color indicated for this case, including reflecting bands or buttons.

Another possibility is the construction of semitranslucid moulds which makes internal night illumination possible, using photoelectric cells with solar energy, batteries, etc. These illuminated moulds shall be placed in the desired places, inserted in between the rest of the barrier.

The barrier made out of white polyester provides sufficient contrast with the environment in which it is installed (asphalt, black or brownish) so that it is visible during the day and night, increasing its visibility in the case of rain, as this would clean the dust from the barriers, increasing the contrast in these cases. It is obvious that its night time visibility shall increase with the installation of reflecting buttons which may be attached in the factory. In areas where fog is a problem, the moulds may be frequently made with a red stripe (38) along the lateral upper part which makes its contrast viewing easier. This is also applicable for areas of a lot of snow.

Warning signs. As a complementary security measure, an acoustic and optical alarm is provided which advises the workers when a vehicle accidentally crosses the safety area, by means of a siren and an emergency light (FIGS. 20, 20*a*).

A mould having a small tube inside, with an electrical wire, whose ends are connected to two terminals located in the transversal faces of each mould, so that when the moulds are connected linearly, they close the electric circuit by means of these terminals (FIGS. 19, 19*a*, 19*b*). When a vehicles moves a mould, a separation occurs, interrupting the electrical circuit in this way. At this moment, a relay fails which is fed through the circuit, causing the battery's supply circuit to close and activating the acoustic or visual alarms. The moulds shall be completely installed upon leaving the factory. In this way, the only things that remains to be done on the highway is the connecting of the final moulds of the chain (first and last) to the circuit.

A 12 to 24 volt battery is enough to supply power to a siren and a lamp for 3 hours, without interruptions. It is possible to recharge the battery without any problems. In order to place the system in its initial cycle, it shall be necessary only to realign the mould or moulds which had been moved. Its design allows placing the siren and emergency lamp in the desired place by simply lengthening the supply wires. The ideal placement of the alarms is in the position closest to the place of work.

I claim:

1. A safety barrier comprising:

a transportable hollow substantially enclosed container, said container made from a lightweight, nondeformable, nonelastic material, said container having a top, a bottom, sides and ends, said container also having a top filler opening and air exist holes located on the top side;

means for coupling an end of said container to an adjacent container, said coupling means including at least one joining member of one gender of a male/female coupler disposed on one end of said container for mating with a joining member of the opposite gender of a male/female coupler disposed on one end of an adjacent container, said joining members being arranged to permit relative vertical movement between said container and an adjacent container without prior horizontal separation; and wherein said container can be transported to a designated place and filled with filler material to give the barrier substantial weight.

2. A barrier as claimed in claim 1, where said coupling means comprises a female channelled joining member on each end of said container, said female channelled joining members engageable with male ribbed joining members of adjacent containers so that a plurality of contained can be adjacently engaged to form a chain of containers.

3. A barrier as claimed in claim 1, wherein said coupling means comprises a male ribbed joining member on each end of said container, said male ribbed joining members engageable with female channelled joining members of adjacent container so that a plurality of containers can be adjacently engaged to form a chain of containers.

4. A barrier as claimed in claim 1, wherein the lightweight material is selected from the group consisting of polyester resin fiber compound, polyester, steel and plastic.

5. A barrier as claimed in claim 1, wherein the filler material is selected from the group consisting of sand, water, soil and concrete.

6. A barrier as claimed in claim 1, wherein:

said container is made from polyester resin compounds strengthened with fiber glass;

said sides and ends have interior faces with reinforcement ribs located along the interior face of the sides and ends; and said container also has an opening located near the bottom for the passage of filler material.

7. A barrier as claimed in claim 6, wherein said reinforcement ribs include transverse ribs located transversally along the interior of said sides of said container.

8. A barrier as claimed in claim 7, wherein said reinforcement ribs include longitudinal ribs located longitudinally along the interior of said sides and communicating with said transversally located reinforcement ribs.

9. A barrier as claimed in claim 1, wherein said opening is positioned at a bottom of a side for the passage of filler material.

10. A barrier as claimed in claim 1, wherein said joining member forms an articulated joint with the joining member of an adjacent container for forming articulated barriers.

11. A barrier as claimed in claim 1, wherein said coupling means forms a semirigid joint with an adjacent container to allow said barrier to absorb the energy of an impact in a vertical component to the barrier, and further to allow disassembly of any of the components of a barrier without prior horizontal separation.

12. A barrier as claimed in claim 1, wherein said container has means for forming a rigid joint with another container.

13. A barrier as claimed in claim 12, wherein said container has anchoring means for anchoring said container to the ground.

14. A barrier as claimed in claim 1, wherein said coupling means has an orifice located in said container end, said coupling means further comprising in said orifice and projecting therefrom, and securing means to secure the rod to a rod of another container.

15. A barrier as claimed in claim 14, wherein said rod is in the form of an "L-shape", said rod hooking with a rod of an adjacent container to secure the container to an adjacent container.

16. A barrier as claimed in claim 14, wherein said rod is in the form of a "hook", said rod hooking with a rod of an adjacent container to secure the container to an adjacent container.

17. A barrier as claimed in claim 14, wherein:

said end of said container is stepped to form a lateral fact at the stepped location; and said rod is inserted in said lateral face when said container is filled with filler material, and said rod remains embedded in said container.

18. A barrier as claimed in claim 1 further comprising means for illuminating said container increased visibility of said container.

19. A barrier as claimed in claim 1 further comprising reflecting bands.

20. A barrier as claimed in claim 1 further comprising means for containing soil and plants.

21. A barrier as claimed in claim 20 further comprising a drop irrigation system.

22. A barrier as claimed 20, further comprising means for containing hydroponic cultivation.

23. A barrier as claimed in claim 20, wherein said barrier has an orifice in a side to allow small animals to cross through the orifice.

24. A barrier as claimed in claim 1 further comprising means for emitting an acoustic warning signal.

25. A barrier as claimed in claim 1 further comprising means for emitting an optical alarm warning signal.

26. A barrier as claimed in claim 11, wherein the lightweight material is selected from the group consisting of polyester, steel and plastic.

27. A barrier as claimed in claim 11, wherein said container is made from a material selected from the group of sand, water, soil and concrete.

28. A mobile safety barrier mould comprising:

a transportable hollow substantially enclosed container, said container made from polyester resin compounds strengthened with fiber glass, said container having a top, a bottom, sides and ends, said sides and ends having interior faces with reinforcement ribs located along the interior face of the sides and ends, said container also has an opening located near the bottom for the passage of filler material;

means for coupling the mould to adjacent moulds;

support legs situated on the bottom to raise the barrier off the road; and means for emitting an acoustic warning signal;

wherein the mould can be transported to a designated place and filled with filler material to give the barrier substantial weight.

29. A mobile safety barrier mould comprising:

a transportable hollow substantially enclosed container, said container made from polyester resin compounds strengthened with fiber glass, said container having a top, a bottom, sides and ends, said sides and ends having interior faces with reinforcement ribs located along the interior face of the sides and ends, said container also has an opening located near the bottom for the passage of filler material;

means for coupling the mould to adjacent moulds;

support legs situated on the bottom to raise the barrier off the road; and means for emitting an optical alarm warning signal;

wherein the mould can be transported to a designated place and filled with filler material to give the barrier substantial weight.

* * * * *

UNITED STATES PATENT AND TRADEMARK OFFICE

CERTIFICATE OF CORRECTION

PATENT NO. : 5,137,391

DATED : August 11, 1992

INVENTOR(S) : Angel G. Ballesteros

It is certified that error appears in the above-identified patent and that said Letters Patent is hereby corrected as shown below:

On the title page: please insert

--- [30] Foreign Application Priority Data

September 15, 1987 [Sp] Spain ----- 8702657 ---.

Signed and Sealed this

Third Day of August, 1993

*Attest:*

Michael K. Kirk

MICHAEL K. KIRK

*Attesting Officer*

*Acting Commissioner of Patents and Trademarks*